US006218918B1

(12) United States Patent
Mawston et al.

(10) Patent No.: US 6,218,918 B1
(45) Date of Patent: Apr. 17, 2001

(54) ELECTRO-MECHANICAL LATCH RELAY

(75) Inventors: Ian G. Mawston, Auckland (NZ); Antonio Chi-Shing Wu, Hong Kong (HK)

(73) Assignee: Glorywin International Group Limited, Kowloon (HK)

( * ) Notice: Subject to any disclaimer, the term of this patent is extended or adjusted under 35 U.S.C. 154(b) by 0 days.

(21) Appl. No.: 09/445,853

(22) PCT Filed: May 29, 1998

(86) PCT No.: PCT/IB98/00840

§ 371 Date: Feb. 25, 2000

§ 102(e) Date: Feb. 25, 2000

(87) PCT Pub. No.: WO99/01881

PCT Pub. Date: Jan. 14, 1999

(30) Foreign Application Priority Data

Jul. 4, 1997 (CN) ..... 97 2 04672

(51) Int. Cl.[7] ..... H01H 67/00

(52) U.S. Cl. ..... 335/106; 335/127; 335/138; 335/167; 335/171; 335/189

(58) Field of Search ..... 335/106, 119–127, 335/131, 132, 138, 167, 171, 185, 189, 190; 200/523–528

(56) References Cited

U.S. PATENT DOCUMENTS

| | | | | |
|---|---|---|---|---|
| 2,892,059 | * | 6/1959 | Keirans | 335/126 |
| 3,873,951 | * | 3/1975 | Blake | 335/164 |
| 4,725,801 | | 2/1988 | Snyder | 335/126 |

FOREIGN PATENT DOCUMENTS

0630034A1 * 12/1994 (EP) .

* cited by examiner

*Primary Examiner*—Ray Barrera
(74) *Attorney, Agent, or Firm*—Seidel, Gonda, Lavorgna & Monaco, PC

(57) ABSTRACT

A mechanical latch relay started by a current pulse is disclosed which comprises an electromagnetic generating unit, a connecting mechanism and a mechanical locking mechanism, and which can maintain the existing operation state when the current pulse starting the relay disappears, and it changes its operation state when another current pulse is provided, and then it keeps the operation state even if the pulse disappears so that it can provide a stable operation state of current on/off unnecessary to be provided with a current for a long time, which enables to provide an effective control for current on/off.

18 Claims, 7 Drawing Sheets

ELECTRO-MECHANICAL LATCH RELAY

FIELD OF THE INVENTION

The present invention relates to a mechanical latch relay started by a latch current pulse, and more particularly, a relay having a mechanical locking means for keeping the operation states provided by the current pulse.

BACKGROUND OF THE INVENTION

At present, most of the commercial relays, when provided with an operation current, can change their output states, e.g. from "on" to "off" or from "off" to "on", and will return to their original states when the current provided disappears. In order to maintain the changed states, the current must be provided constantly. An improved relay is on the market to overcome this drawback which needs only a single pulse to keep the changed state. The most relative prior art is the latch relay manufactured by COLE HERSEE CO., U.S.A., but it is complicated, large, and unstable in operation since it requires three springs.

SUMMARY OF THE INVENTION

The present invention provides at least a mechanical latch relay activated by a latch current pulse in which a mechanical locking means allows an operating current to maintain its present operating state of the latch relay when the latch current pulse is removed and changes its operating state of the latch relay when another latch current pulse is provided, and then keeps the new operating state when the latch current pulse is removed thereby eliminating the necessity to continuously provide the latch current pulse for a particular operating state.

The present invention further provides at least a mechanical latch relay started activated by a latch current pulse, which provides a stable operating state of on/off current for effective control of on/off current.

The present invention further provides at least a mechanical latch relay started by a very short latch current pulse.

The present invention further provides at least a mechanical latch relay which is convenient to operate, time and energy efficient, simple in structure, cheap to manufacture, and which may enable large current.

To achieve the above objects, the present invention provides a mechanical latch relay comprising a casing with two connecting holes on a side thereof for receiving a latch current pulse metal plates on a bottom thereof for connecting to an external circuit a cavity including at a center of the bottom side grooves and a cover on an upper end thereof; an electromagnetic generating unit, a connecting means and a locking means housed within said casing, said electromagnetic generating unit includes a coil assembly for generating an electromagnetic field including a central bore and a rotor spring positioned in said central bore; said connecting means includes a connecting plate having a bolt on one side of said connecting plate and a columnar rotor which is inserted into said rotor spring on the other side thereof, said locking means comprises a small spring positioned in said cavity a locking component placed on said small spring and a clamping part with clamping tabs; said locking component is a cylinder having teeth at one end thereof for engaging with said clamping tabs and a gear on the periphery thereof for engaging with side grooves of said cavity.

The advantages of the present invention lie in that it can provide a stable operating state for on/off current, and it enables an effective control for on/off current. Moreover, since the metal plate for connecting with an external circuit is made of special material, the range of output current is greatly extended, e.g. from 0 to 250 A.

DESCRIPTION OF THE DRAWINGS

An embodiment of the present inventionl will described with the attached drawings, in which.

DESCRIPTION OF THE INVENTION

Figure 1:
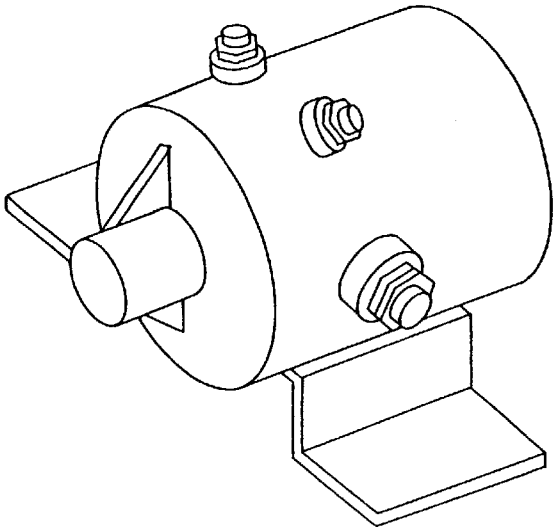
FIG. 1 PRIOR ART
FIG. 1 is a perspective view of a latch relay according to the prior art.
Figure 2:
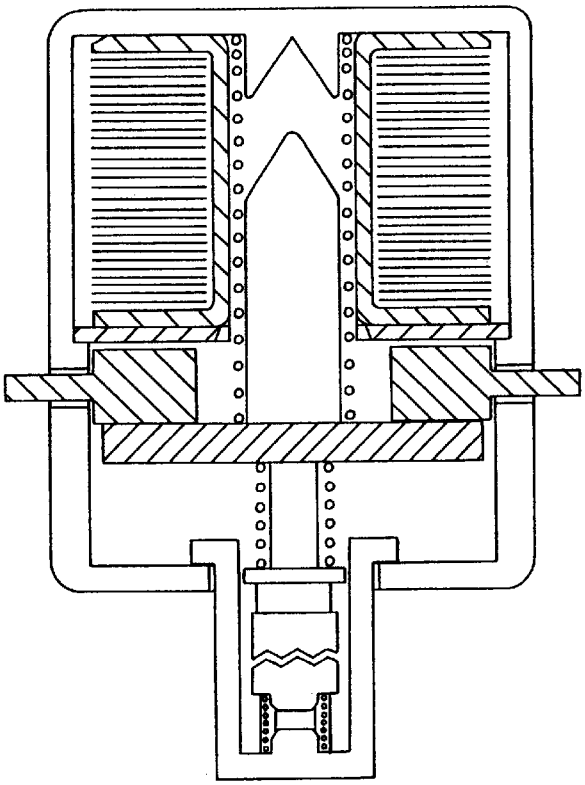
FIG. 2 PRIOR ART
FIG. 2 is a sectional view of the latch relay according to the prior art.

FIGS. 1 and 2 show a latch relay according to the prior art, manufactured by COLE HERSEE CO., U.S.A., which has an external size 80 mm×85 mm×62 mm, and which has a large volume, a complicated structure and is unstable in operation since it requires three springs.

Figure 3:
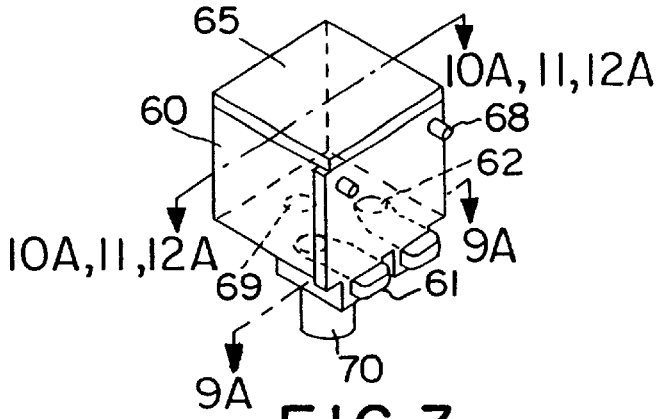
FIG. 3 is a schematic perspective view of a casing of a mechanical latch relay of the present invention.
Figure 4:
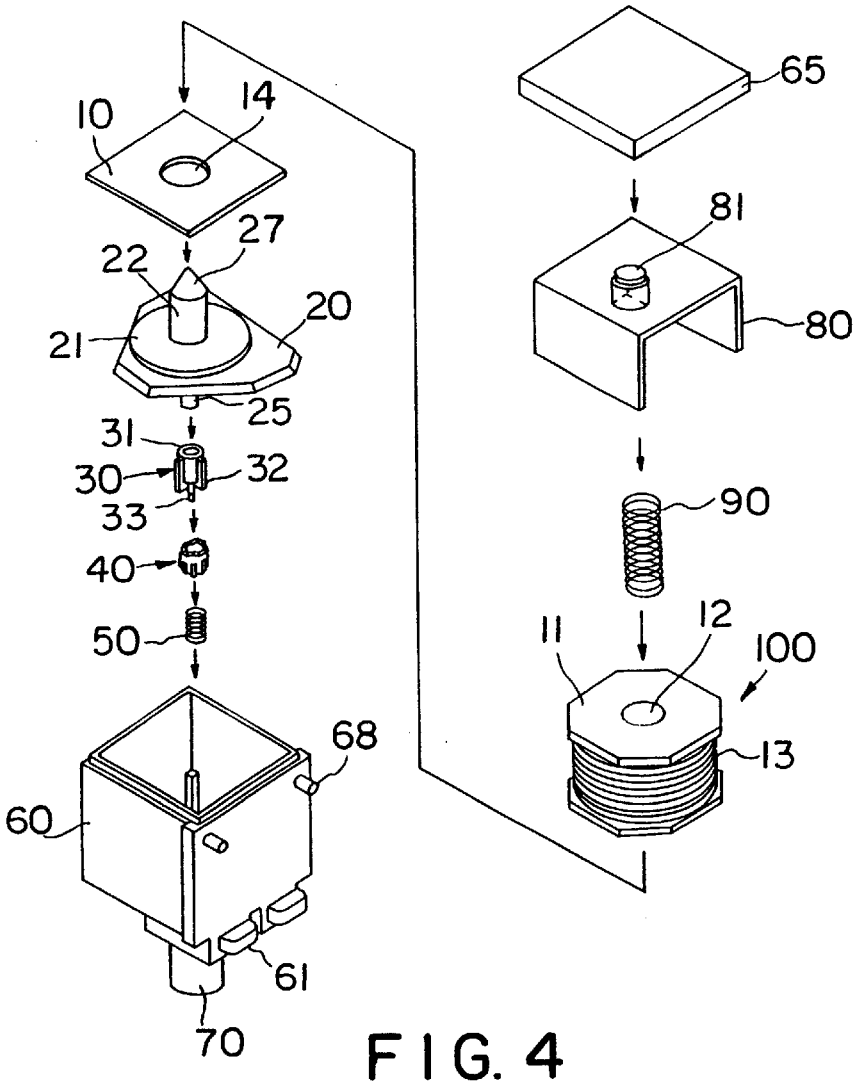
FIG. 4 is an exploded view of an electromagnetic generating unit, a connecting means, a mechanical locking means, and a casing of a mechanical latch relay of the present invention.

Referring to FIGS. 3 and 4, the mechanical latch relay of the present invention includes a casing 60 for containing an electromagnetic generating unit that produces a magnetic field, a connecting means and a locking means for maintaining a current on/off states (discussed in detail below). Two projecting metal plate 61 for connecting to an external circuit are provided on the bottom of the casing 60, the metal plates 61 may be made of pure copper coated with tin. The other end of each metal plate 61 is inlaid on the bottom of casing 60 by a rivet made of silver alloy whose head 62 projects inwards from the bottom of the casing. Moreover, on the inside bottom of the casing 60, in addition to the two rivet heads for connecting to an external circuit, there is a contact 69 providing a third contact point for contacting a connecting plate. The third contact point may also connect a detecting circuit so as to monitor the on/off state of the current to an external circuit. On the center of the bottom of casing 60 there is a cavity 70 which projects outwards and is provided with grooves in its interior wall for engaging with the locking component of the locking means. Two coil connecting holes 68 used for transmitting a latch current pulse to the coil assembly are installed on one side of casing 60. On the other end of casing 60 is a cover 65, both casing 60 and cover 65 are made of superior quality polyethylene through die casting, and are soldering sealed by ultrasonic technology.

Figure 5A:
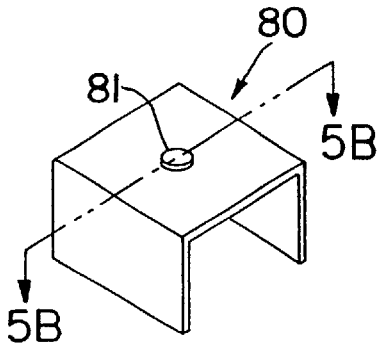
FIG. 5A is an enlarged perspective view of a U-plate of the mechanical latch relay of the present invention.
Figure 5B:
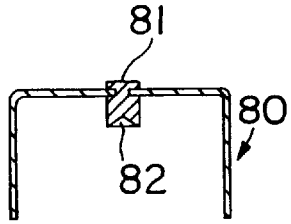
FIG. 5B is a sectional view of the U-plate of the mechanical latch relay of the present invention illustrated in FIG. 5A taken along line 5B—5B.

FIG. 4 is a schematic view showing the interior parts of a mechanical latch relay of the present invention. The relay comprises a coil assembly 100 made of polyurethane insulated copper wire 13 wound about a reel 11 made of polysulfone through casting, both ends of copper wire 13 extending out connecting holes 68 in one side of the casing and connecting to a source of the latch current pulse. In the middle of reel 11 is an axle hole 12 in which a rotor spring 90 is positioned. Referring to FIGS. 4, 5A and 5B, a U-iron plate 80 presses upon an upper end of the coil assembly 100, and on another end of the coil assembly 100 there is a magnetic field occlusor 10 which cooperates with U-iron plate 80 to enclose the coil assembly 100 so that a closed magnetic circuit is generated when a latch current pulse passes through the copper wire 13 which enhances the magnetic force. In the center of the U-iron plate 80 there is an inward projecting column 81 whose diameter and position are designed in such a way that the column 81 can complementarily engage the rotor spring 90. An inward projecting conic groove 82 is provided at one end of column 81, as shown in FIG. 5B. The rotor spring 90 is made of superior quality steel coated with nickel.

The connecting means includes a magnetic field augment piece 21 and a connecting plate 20 secured to the augment piece 21. A column is installed at the center of magnetic field augment piece 21 and connecting plate 20. One end of the column is a columnar rotor 22 and the other end is a bolt 25 having a relative thickness less than the rotor 22. One end of columnar rotor 22 is shaped as outer cone 27 matching the inward projecting conic groove 82 of column 81 mounted on the U-iron plate 80. During installation columnar rotor 22 inserts through a hole 13 of magnetic field occlusor 10, into the rotor spring 90 positioned in coil assembly 100 axle hole 12 with the inward projecting conic groove 82 of column 81 matching well with the outer cone 27 at the end of columnar rotor 22. Thus, when the electromagnetic generating unit consisting of the U-iron plate 80, coil assembly 100, and magnetic field occlusor 10 generates a magnetic field and magnetic force upon receiving the latch current pulse the U-iron plate 80 and the magnetic field augment piece 21 press against the elastic force of the rotor spring 90 of coil assembly 100 under the magnetic force, with the inward projecting conic groove 82 of column 81 closely fitting with outer cone 27 at the end of the columnar rotor 22. When the latch current pulse is removed, the magnetic force fades away concurrently, and the U-iron plate 80 and the magnetic field augment piece 21 move in the opposite direction due to the elastic force of the rotor spring 90, thereby the inward projecting conic groove 82 of column 81 separates from the outer cone 27 at the end of the columnar rotor 22.

Figure 6A:
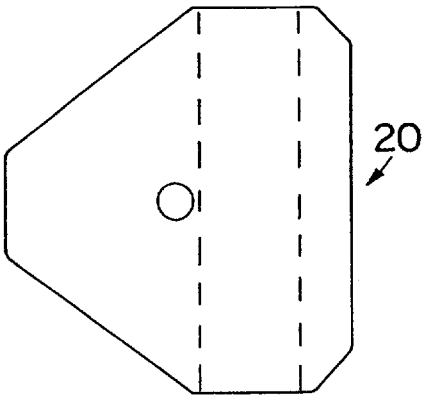
FIG. 6A is a top view of a connecting plate of the mechanical latch relay of the present invention.
Figure 6B:
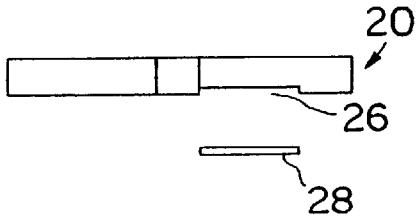
FIG. 6B is a side view of the connecting plate of the mechanical latch relay of the present invention.

Referring now to FIGS. 6A and 6B a shallow slot 26 is provided in one end of the connecting plate 20 on the same side of the bolt 25 for containing a metal slab 28 which has the features of high electric conductivity, high thermal conductivity, high resistance to electric arc, high mechanical stability, high hardness, and light weight, etc., so as to facilitate switching on larger current output. The metal slab 28 is made of silver-copper alloy, for example, 92.5% silver and 7.5% copper. When the metal slab 28 contacts a rivet head 62 at the internal end of the casing for securing the external circuit board, the external circuit is switched on. As illustrated in FIGS. 6A, 6B, the connecting plate 20 may be made into a triangular shape so as to reduce its weight and volume.

Figure 7A:
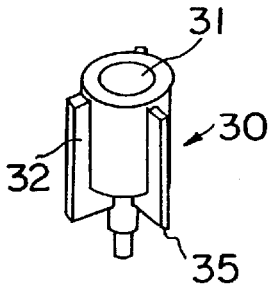
FIG. 7A is an enlarged perspective view of a clamping element of the mechanical latch relay of the present invention.
Figure 7B:
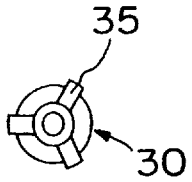
FIG. 7B is a bottom view of the clamping element of the mechanical latch relay of the present invention shown in FIG. 7A.
Figure 8A:
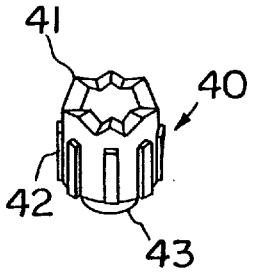
FIG. 8A is an enlarged perspective view of a locking component of the mechanical latch relay of the present invention.
Figure 8B:
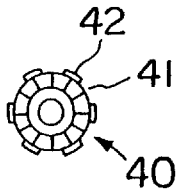
FIG. 8B is a top view of the locking component of the mechanical latch relay of the present invention shown in FIG. 8A.

The mechanical latch relay of the present invention is provided with a locking means which comprises a small spring 50 positioned in a locking cavity 70 of the casing 60, a locking component 40 placed on the small spring 50, and a clamping part 30; the clamping part 30 has columnar shape, at the center of one end of which is an inner hole 31 for receiving bolt 25, and on the periphery of which are evenly distributed every 120° three clamping tabs 32 the bottom edges of the clamping tabs 32 form a slope 35; a small column head 33 is located at the center of the other end of the clamping part 30 for insertion into a hollow hole of the locking component 40, as shown in detail in FIGS. 7A and 7B. The locking component 40 is a hollow cylinder, provided with teeth 41 at one end thereof whose shape and size match the slope 35 of the clamping tabs 32, a bead 43 with a smaller diameter than the other end thereof, and a gear 42 on the periphery thereof, whose shape and size match the side grooves 72 on the interior wall of cavity 70 in casing 60, as shown in detail in FIGS. 8A and 8B. The component 40 and the clamping part 30 are made of polyvinylacetate through casting which has good thermal stability, and the surface that engages with the cavity 70 is made of copper-nickel alloy, which may extend its service life.

Figure 9A:
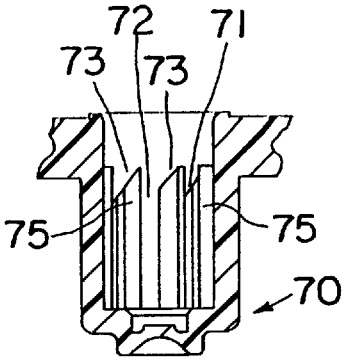
FIG. 9A is a sectional view of a locking cavity of the mechanical latch relay of the present invention.
Figure 9B:
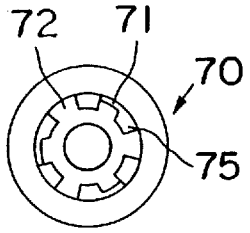
FIG. 9B is a top view of the locking cavity of the mechanical latch relay of the present invention shown in FIG. 9A.

FIGS. 9A, 9B illustrate the locking cavity 70 of the casing 60 which includes interior circumstance wall having ribs 75 with end faces 73, half grooves 71 and full grooves 72. When the clamping tabs 32 are clamped in half grooves 71, the metal slab 28 on the connecting plate 20 does not contact the rivet head 62 in the casing 60 and the external circuit is switched off. When the clamping tabs 32 are positioned in the bottom of full grooves 72, the metal slab 28 on the connecting plate 20 contacts the rivet head 62 in the casing 60 and the external circuit is switched on.

Now the operating principle of the mechanical latch relay of the present invention will be explained with the attached drawings.

Figure 10A:
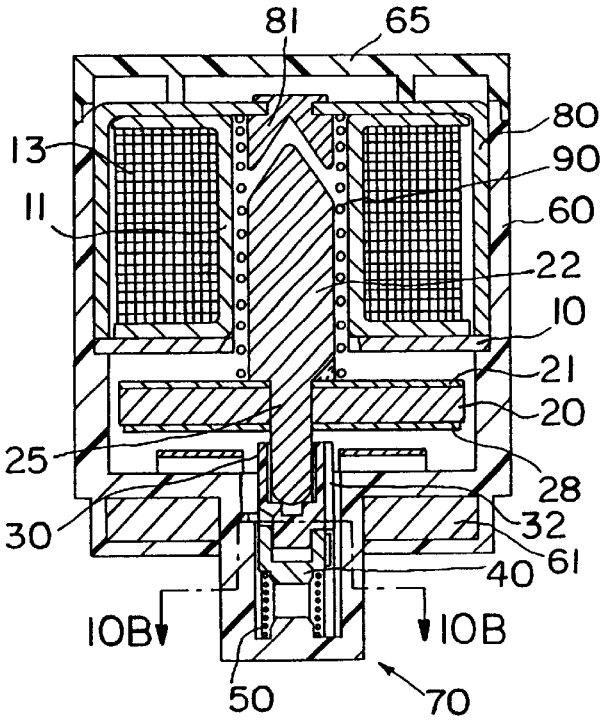
FIG. 10A is a sectional view of the mechanical latch relay of the present invention shown in FIG. 3 taken along line 10A—10A in an output current "off" state.
Figure 10B:
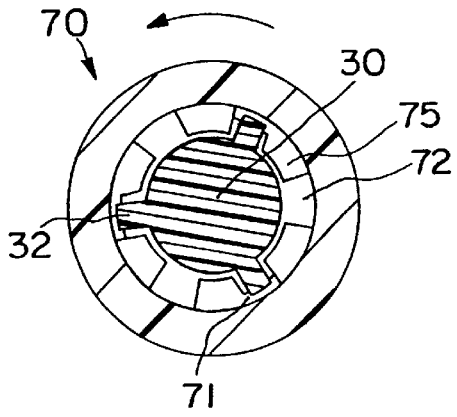
FIG. 10B is a sectional view of the mechanical latch relay of the present invention shown in FIG. 10A taken along line 10B—10B in an output current "off" state.

First referring to FIGS. 10A, 10B, the metal slab 28 on the connecting plate 20 does not contact the rivet head 62 in the casing, and therefore the external circuit is in a "turn-off" state. At this time, the clamping tabs 32 of the clamping part 30 engage the half grooves 71 in the cavity 70 and the rotor spring 90 located between the magnetic field occlusor 10 and the U-iron plate 80 assumes a half-pressed status. An elastic force is transmitted to the clamping part 30 via the columnar rotor 22 and the bolt 25. The small spring 50 also exerts a force to the clamping part 30 via the locking component 40 so as to enable the clamping tabs 32 to be firmly clamped on the half grooves 71 without rotation.

Figure 11:
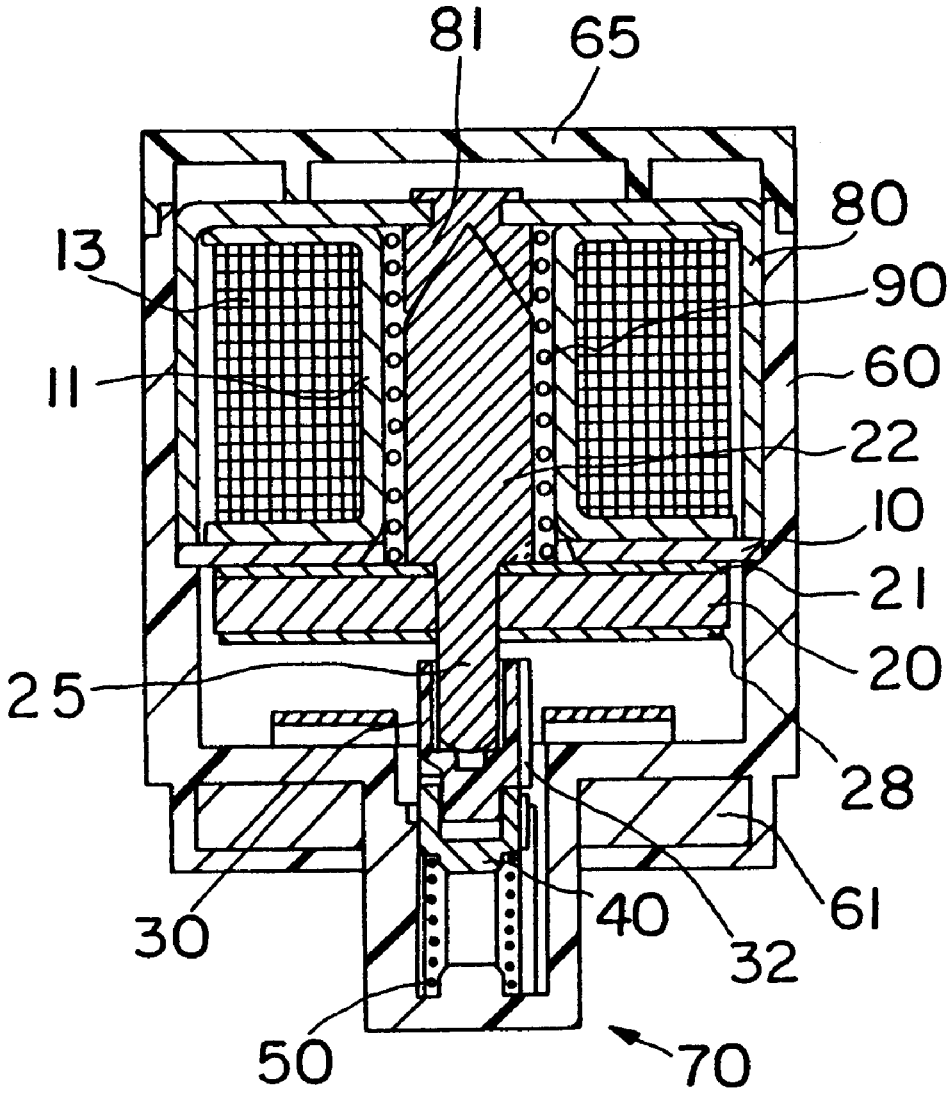
FIG. 11 is a sectional view of the mechanical latch relay of the present invention shown in FIG. 3 taken along line 11—11, showing current "off" state turning the mechanical latch relay when a latch current pulse is provided.

Referring to FIG. 11, now a latch current pulse is transmitted to the coil assembly 100 through coil connecting holes 68, which generates a magnetic field with different polarities at both ends of the coil. Due to magnetic force attraction, the U-iron plate 80 and magnetic field augment piece 21 press onto the coil assembly 100 against the elastic force of the rotor spring 90, and the inward projecting conic groove 82 of column 81 leading out from the U-iron plate 80 closely fits with the outer cone 27 at the end of the columnar rotor 22. At the moment, the elastic force of the small spring 50 pushes the clamping tabs 32 out of the half grooves 71 in the cavity 70 through the locking component 40. Due to the movement between the slope 35 of the clamping tabs 32 and the teeth 41 of the locking component 40 and the action of the rotor springs 90, the clamping part 30 performs a tiny rotation, which enables an apex of the slope 35 to stick against the end face 73 of a rib, slide down along it and rotate (along the arrow direction in FIG. 10B), until the clamping tabs 32 align with the full grooves 72, referring also to FIG. 9A.

Figure 12A:
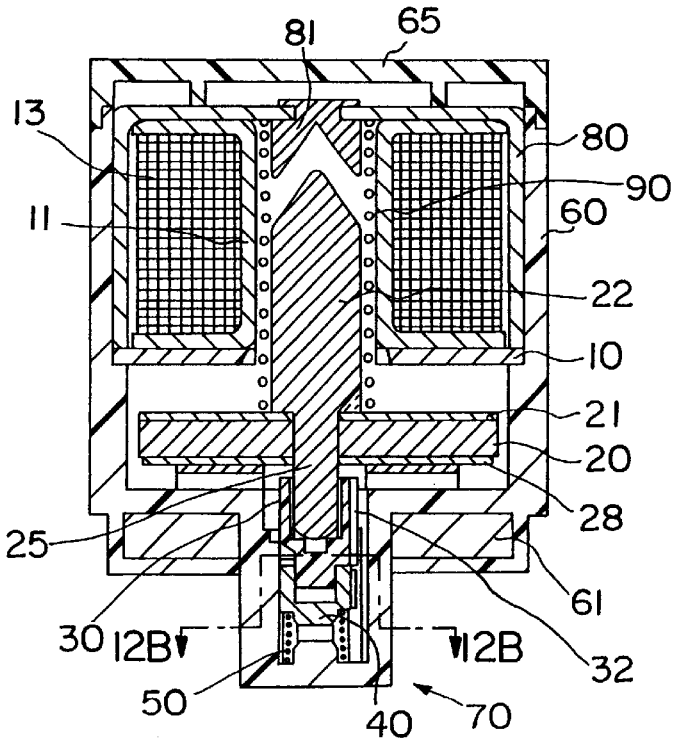
FIG. 12A is a sectional view of the mechanical latch relay of the present invention shown in FIG. 3 taken along line 12A—12A, in an output current "on" state.
Figure 12B:
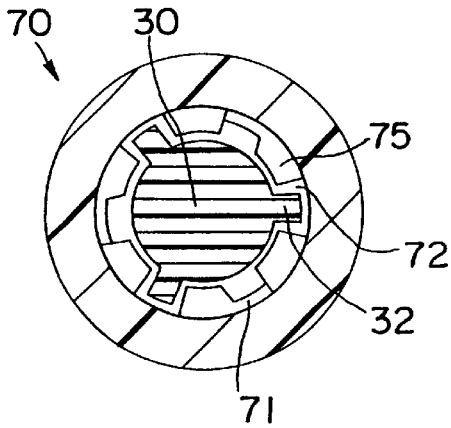
FIG. 12B is a sectional view of the mechanical latch relay of the present invention shown in FIG. 12 A taken along line 12B—12B, in an output current "on" state.

Finally referring to FIGS. 12A and 12B, when a latch current pulse is removed, a repulsive force is generated upon magnetic field variation which, together with an elastic force of the rotor spring 90, pushes the connecting plate 20 to the bottom. Since the clamping tabs 32 are already aligned with the full grooves 72 in the cavity 70, it can move toward the bottom of the cavity 70 without resistance so as to enable the connecting plate 20 to contact with rivet head 62, and the external circuit is switched on.

If another latch current pulse comes due to the magnetic force, the U-iron plate 80 and the magnetic field augment piece 21 press down on the coil assembly 100 again, the connecting plate 20 separates from the rivet head 62, and the circuit is turned off. At that moment, the clamping tabs 32 are pushed out from the full grooves 72 in the cavity 70 by the elastic force of the small spring 50. Similarly, due to the movement between the slope 35 of the clamping tabs 32 and the teeth 41 of the locking component 40 and the action of the rotor spring 90, the clamping part 30 performs a tiny rotation, which enables an apex of slope 35 to stick against the end face 73 of another rib, slide down along it and rotate (along the arrow direction in FIG. 10B), until the clamping tabs 32 are aligned with the half grooves 71. When the latch pulse current pulse is removed due to the action of a magnetic field repulsive force and an elastic force of the rotor spring 90, the clamping tabs 32 are pushed into the half grooves 71. At that moment, the circuit maintains "off" state until the next pulse appears.

In summary, when a latch current pulse is input to the relay of the present invention, the state of the external circuit varies. Then, even if the latch pulse current pulse is removed, the status will be retained. A latch current pulse needs to be input again to change the status of the external circuit. Thus, a stable operating status of current on/off is provided, which enables an effective control for current on/off.

The present invention may be embodied in other specific forms without departing from the spirit or essential attributes thereof and, accordingly, reference should be made to the appended claims, rather than to the foregoing specification, as indicating the scope of the invention.

What is claimed is:

1. A mechanical latch relay activated by a latch current pulse, comprising:

a casing (60), connectable to a current source, the casing including a bottom, a plurality of side walls and a cover (65) forming a generally closed cavity;

at least two metal plates (61) extending from the bottom for connecting to an external circuit, each metal plate including a contact element (62) extending into the casing cavity;

a generally cylindrical housing forming a cavity (70), the housing cavity open to the casing cavity, the housing cavity including side grooves about the interior wall thereof;

a electromagnetic generating unit for generating an electromagnetic field positioned within said casing cavity, said electromagnetic generating unit including a coil (100) with a central bore (12) co-axial with the housing cavity;

a connecting means movable axially to and from a position in which it contacts the said contact elements (62);

a locking means within said casing, said locking means comprising a locking component (40) and a clamping part (30) including clamping tabs (32);

said locking component (40) being a cylinder provided with teeth (41) at one end thereof for engaging with said clamping tabs (32) and a gear (42) on the periphery of the cylinder positioned within side grooves (71, 72) of said cavity (70);

said clamping tabs (32) so engaging said teeth (41) and the side grooves (71, 72) of the cavity (70) that axial reciprocation of the locking component (40) causes indexed rotation of the clamping part (30) between positions in which the connecting means (20) contacts and does not contact the contact elements (62);

and a coil spring (90) pressing the clamping part (30) into the side grooves (71, 72) of the cavity (70); characterised in that the generally cylindrical housing extends from a center of the said bottom of the casing (60);

the connecting means includes a connecting plate (20) disposed between the electromagnetic generating unit and the housing and having a bolt (25) on a first side of said connecting plate and a columnar shaft (22) on the second side of said connecting plate (20), the columnar shaft (22) positioned within the central bore (12) of the coil (100);

the coil spring (90) is positioned within the central bore (12) of the coil (100) and around the columnar shaft (22) and a second spring (50), weaker than the coil spring (90), is positioned in the housing cavity (70) and presses the locking component (40) against the clamping part (30); and the connecting means (20) is pressed by the said coil spring (90) towards the position in which the connecting plate (20) contacts the said contact elements (62), and is moved away from that position by magnetic force attraction when the electromagnetic generating unit is activated.

2. The mechanical latch relay according to claim 1, wherein said housing cavity includes ribs (75), half grooves (71) ad full grooves (72) on the interior circumferential surface thereof.

3. The mechanical latch relay according to claim 2, wherein said ribs (75) are provided with inclined end faces (73).

4. The mechanical latch relay according to claim 3, wherein said clamping tabs (32) include a slope (35) at lower edges thereof engaging with the inclined end faces (73) of said ribs (75).

5. The mechanical latch relay according to claim 1, wherein said electromagnetic generating unit further comprises a U-iron plate (80) and a magnetic field occlusor (10) mounted on an end of the coil (100).

6. The mechanical latch relay according to claim 5, further comprising an inner projecting column (81) at the center of said U-iron plate (80), the inner projecting column having a position and diameter such that it can be introduced into said coil spring (90).

7. The mechanical latch relay according to claim 1, wherein said connecting means further comprises a magnetic field augment piece (21) secured to said connecting plate (20).

8. The mechanical latch relay according to claim 6, wherein one end of said columnar shaft (22) presents a projecting conic shape (27) and said inner projecting column (81) includes an inwardly projecting conic groove (82) at the center thereof, positioned to mate with said projecting conic shape of said columnar shaft.

9. The mechanical latch relay according to claim 1, further comprising a shallow slot (26) at one end of said connecting plate (20) on the same side as said bolt (25) and a metal slab (28) positioned within said slot.

10. The mechanical latch relay according to claim 9, wherein said metal slab (28) is made of silver-copper alloy.

11. The mechanical latch relay according to claim 10, wherein said metal slab (28) is made of 92.5% silver and 7.5% copper.

12. The mechanical latch relay according to claim 1, wherein said connecting plate (20) is triangular in shape.

13. The mechanical latch relay according to claim 1, wherein there are three clamping tabs (32) evenly distributed in spacing 120° with each other on the periphery of said clamping part (30).

14. The mechanical latch relay according to claim 1, wherein said locking component (40) and clamping part (30) are made of polyvinylacetate with good thermal stability through casting, the surface thereof abutting with said cavity (70) are made of copper-nickel alloy.

15. The mechanical latch relay according to claim 1, further comprising an inner hole (31) matching said bolt (25) provided at one end of said clamping part (30) and a projecting small column head (33) provided at the other end thereof.

16. The mechanical latch relay according to claim 15, wherein said locking component (40) is hollow and receives said small column head (33).

17. The mechanical latch relay according to claim 1, further comprising a bead with a smaller diameter provided at one end of said locking component (40) secured to said second spring (50).

18. The mechanical latch relay according to claim 1, further comprising a contact (69) for engaging with said connecting plate (20) provided on the bottom of said casing.

* * * * *